United States Patent [19]

Mason

[11] 4,109,328

[45] Aug. 29, 1978

[54] MODULAR FURNITURE SYSTEM

[75] Inventor: Lewis M. Mason, Pacific Palisades, Calif.

[73] Assignee: M & S Industries, Inc., Los Angeles, Calif.

[21] Appl. No.: 820,486

[22] Filed: Jul. 29, 1977

[51] Int. Cl.[2] ..... A47B 83/00; A47B 87/00

[52] U.S. Cl. ..... 5/2 R; 5/8; 312/111; D6/80

[58] Field of Search ..... 5/2 B, 8, 9 R, 9 B, 5/2 R; 312/198, 111; D6/79, 80, 81, 82, 83

[56] References Cited

U.S. PATENT DOCUMENTS

| | | | |
|---|---|---|---|
| D. 206,427 | 12/1966 | Fowler | 5/8 |
| D. 227,723 | 7/1973 | Mendlin | D6/80 |
| 807,360 | 12/1905 | Coyle | 5/331 |
| 1,949,326 | 2/1934 | Peterson | 312/198 |
| 2,358,160 | 9/1944 | Maak | 312/111 |
| 2,665,963 | 1/1954 | Wallack | 312/198 |
| 3,234,896 | 2/1966 | Bonsall | 312/111 |
| 3,316,564 | 5/1967 | Rogers, Jr. | 5/8 |
| 3,325,233 | 6/1967 | Oppenhuizen et al. | 5/9 R |
| 3,338,648 | 8/1967 | Bannister | 5/8 |

FOREIGN PATENT DOCUMENTS

| | | | |
|---|---|---|---|
| 846,878 | 8/1960 | United Kingdom | 5/8 |

*Primary Examiner*—Mervin Stein

*Assistant Examiner*—Alex Grosz

[57] ABSTRACT

A modular furniture system is disclosed which consists of functional modules that can be oriented, stacked and interlocked to create different furniture assemblies. The modules include identical rectangular enclosures, one of which contains drawers and another a cupboard and retractable writing surface. The enclosures can be stacked one on top of the other with a portion of the uppermost enclosure supporting one end of an upper bunk bed module. Another support means supports the other end of the bunk bed. An apparatus is also disclosed for interlocking the stackable enclosures and the upper bunk bed end to the uppermost enclosure. A removable cover is provided for the exposed portion of the uppermost enclosure adjacent the end of the bunk bed. By varying the width of the removable cover, a shelf of variable area can be provided. One end of a lower bunk bed module can be positioned within the enclosure formed by the upper bed and its two end supports. In addition, the bunk beds have removable side boards and removable head boards attachable to either side or either end of the bunk beds. The modules can be arranged so that the upper bunk bed can be longitudinally disposed along any wall of a room with either support structure adjacent any corner and the length of the combined bunk bed and end support structures can be varied according to the available space.

30 Claims, 7 Drawing Figures

MODULAR FURNITURE SYSTEM

FIELD OF THE INVENTION

The invention relates to modular furniture systems, and more particularly to modular furniture systems having stackable, interlocking modules.

BACKGROUND OF THE INVENTION

Bedroom furniture and convertible sofa combinations utilized in the past are many and varied. Most required additional dressers, chests and desk units whenever storage and writing surface requirements existed. Whenever a chest, dresser or desk was required, it utilized additional floor space thereby giving a crowded appearance to a small room. Standard bunk beds were usually mounted one over the other and served no other purpose than to provide sleeping space for two. A typical configuration provided for an upper bunk to be mounted on top of vertically extending posts which also provided support for a lower bunk. The vertically extending posts frequently had dowels extending upwardly from their top ends which were disposed within holes provided in the upper bunk support structure. These dowels frequently resulted in the upper bunk being unsteady and dangerous. An additional problem with standard furniture systems was that the various pieces were frequently selected with a particular room in mind and a specific amount of available floor space. These systems could not be moved readily to another room with different space and window configurations.

Corner furniture combinations incorporating two beds also have been utilized previously. One such combination employed a bottom structure supporting an upper bed, the support structure headboard end forming an enclosure into which a lower bed end could be slidably inserted. This enclosure was created by modifying the structure headboard end while still maintaining a "single-piece" character of the structure through common members such as bed supports and a backboard which extended the full length of the upper bed. Once configured for two beds as above described, reconfiguration of the support structure for only one bed was both expensive and difficult.

The furniture system disclosed herein eliminates the problems described above by providing modules which can support an upper bunk while also providing drawer, cupboard, desk and shelf space.

SUMMARY OF THE INVENTION

The invention disclosed herein comprises furniture modules which can be stacked or placed relative to each other to form variously configured furniture assemblies. In one embodiment the furniture modules include a plurality of stackable enclosures, a removable cover for a portion of the uppermost stacked enclosure top, a rectangular upper mattress support frame having two vertically extending end walls, two vertically extending side walls and a top capable of supporting a mattress. The enclosures are formed so that when stacked one on another they are interlocked to provide a single vertically extending structure. Each enclosure is either configured as a cupboard having two hinged doors and a pull-out writing surface or as a chest having two slidable drawers. The top portion of the uppermost stacked enclosure provides support for the upper mattress support frame at one end. A support means is provided for supporting the mattress frame at the other end.

In another embodiment, the support means consists of an H-shaped frame with the top ends removably attached to the upper mattress support frame and the bottom ends extending to the floor. The stacked enclosures which support one end of the upper mattress support frame can be positioned under the mattress frame so that the top of the uppermost enclosure is either completely covered by the end of the mattress support frame or extends outwardly longitudinally from the end of the mattress frame with only a portion of the top of the uppermost enclosure directly supporting the upper mattress support frame. The removable cover is sized so that it will rest on the top portion of the uppermost enclosure not directly supporting the upper mattress support frame thereby providing a shelf of varying width. An upper bunk support structure combination having a variable longitudinal dimension can be created merely by varying the size of the removable cover.

The invention includes means for interlocking the stacked enclosures and for interlocking the upper mattress support frame end to the uppermost stacked enclosure. In one embodiment the interlocking means for the stacked enclosures consists of removable slats extending upwardly from the inner surface of a lower enclosure into the bottom of an upper enclosure so that the upper enclosure is prevented from moving in a horizontal plane subsequent to stacking. The upper mattress support frame side walls extend downwardly further than the end walls of the mattress frame. These downwardly extending side walls overlap the uppermost stacked enclosure front and back sides so that the mattress support frame cannot slide outwardly with respect to the stacked enclosure. Longitudinal sliding is prevented by a removably mounted crossbar on the top of the uppermost enclosure which extends upwardly to abut the mattress support frame end wall inner surface. The upper mattress support frame can be positioned with respect to the uppermost stackable enclosure merely by changing the location of the crossbar previously described and utilizing a removable cover having a width corresponding to the uppermost enclosure top portion which is not directly supporting the upper mattress support frame.

The space formed beneath the upper mattress support frame and between the stacked enclosures and the support means frame can be used for placement of a lower mattress support frame. In one embodiment the lower mattress support frame incorporates two side-by-side drawers in one side wall and is commonly known as a captain's bed. The lower mattress support frame and associated drawer assembly can be placed so that it extends longitudinally at a 90 degree angle with respect to the upper mattress support frame. Thus, an embodiment incorporating two stacked enclosures offset with respect to the upper mattress support frame end, a two-bed assembly having four drawers, a large cupboard, and a storage shelf is provided.

In another embodiment a bookshelf can be used in lieu of the previously described H-shaped frame, the top shelf thereof providing support for the other end of the mattress support frame. Also included in the furniture modules are sideboards and headboards each containing downwardly extending slats which can be removably mounted to either side wall and either end wall, respectively, of the upper and lower mattress support frames. Thus, the above-described assembly can be configured as a mirror image of the original configuration without the replacement of any furniture modules.

In a second embodiment, a single stackable enclosure is utilized to support one end of the upper mattress support frame and a shorter H-shaped support structure is used to support the other end. The enclosure created thereby provides space for insertion of one end of a second mattress support frame. This configuration provides a two-bed corner assembly which requires a minimum amount of floor space.

In a third embodiment, two stackable enclosures are placed side by side with their tops supporting a mattress support frame and interlocked in the manner as previously described. If more floor space is available, one or both of the enclosures can be offset longitudinally with respect to the ends of the mattress support frame and removable covers placed over the top portions not directly supporting the mattress support frame. Thus a single bed with built in drawers, a cupboard, and retractable writing surface is provided with the same basic furniture modules. Also a removable bookshelf module is slidably insertable between the spaced apart stacked enclosures.

BRIEF DESCRIPTION OF THE DRAWINGS

The invention may best be understood when considered in light of the following detailed description taken in conjunction with the accompanying drawings, wherein.

DETAILED DESCRIPTION

This invention utilizes a furniture system having modules which can be arranged in various ways to provide differently configured bed, storage and writing assemblies. Some of the modules incorporate an interlocking apparatus to provide a stable and safe furniture assembly.

Figure 1:
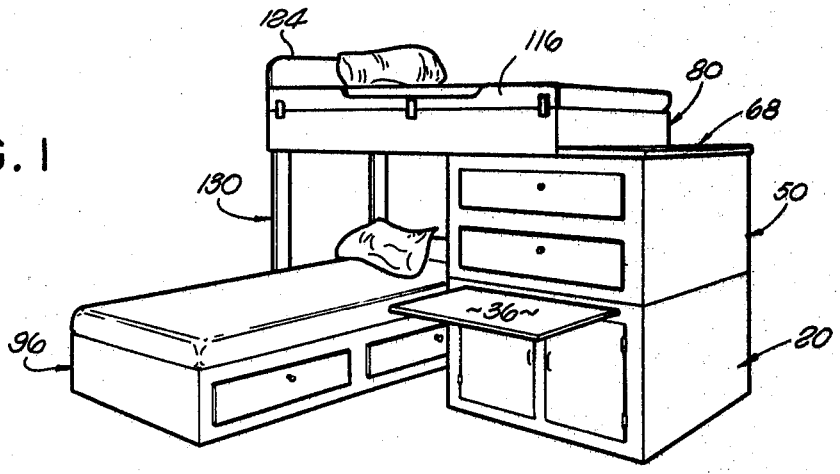
FIG. 1 is a perspective view of a first embodiment of the invention utilizing some of the furniture modules.
Figure 2:
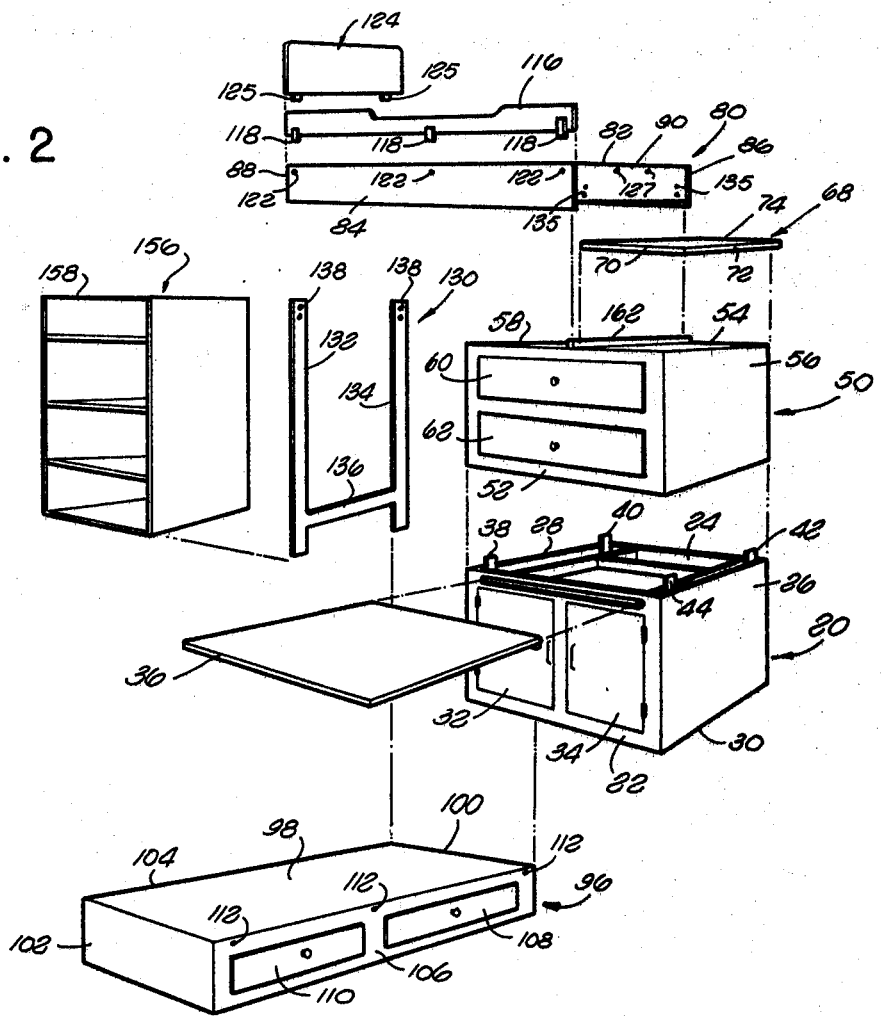
FIG. 2 is an exploded view of the furniture modules used in the FIG. 1 embodiment plus a perspective view of a bookcase which can be used to support the upper mattress support frame in lieu of the H-shaped support structure shown in FIG. 1.

The furniture modules comprising the assembly shown in FIG. 1 can be seen in FIG. 2. Referring to FIG. 2, a cupboard configured stackable enclosure 20 having a front side 22, a back side 24, a right end side 26, a left end side 28 and a bottom 30 is provided. Hinged doors 32 and 34 allow access to the enclosed volume. A retractable writing surface 36 is located above the hinged doors 32 and 34. Four identical slats 38, 40, 42, and 44 are provided at the corners, two 38 and 40 of which are removably attached to the inner left end side 28 surface and two 42 and 44 of which are removably attached to the inner right end side 26 surface. The slats 38, 40, 42 and 44 extend upwardly above a plane defined by the upper edges of the enclosure sides 22, 24, 26 and 28.

Figure 6:
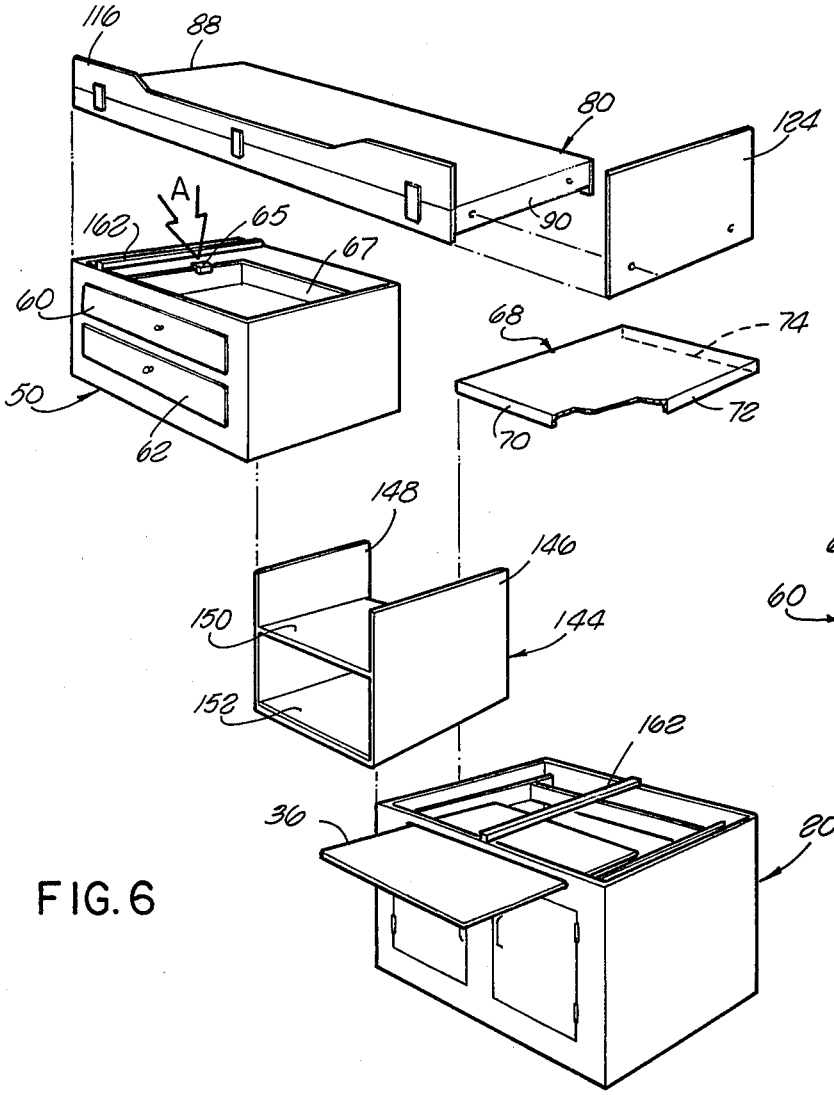
FIG. 6 is an exploded view showing the furniture modules utilized in the FIG. 5 embodiment; and, FIG. 6A is an enlarged, cut-away view showing one of the U-shaped channels used to prevent the chest drawers from inadvertently sliding out while being opened.
Figure 6A:
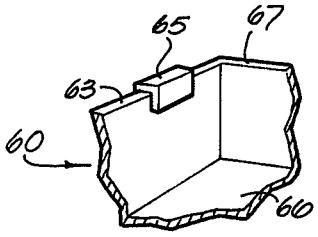

A drawer configured stackable enclosure 50 having a front side 52, back side 54, right end side 56 and left end side 58 is also provided. The perimeter formed by the sides 52, 54, 56 and 58 is the same as that of the cupboard configured enclosure sides 22, 24, 26 and 28. Slidably mounted in the front side 52 are an upper drawer 60 and lower drawer 62 each having inverted U-shaped channels slidably supported by the drawer side walls. One drawer side wall 63 and U-shaped channel 65 combination is shown in FIGS. 6 and 6A. As the drawer is pulled outwardly, the U-shaped channels eventually abut against the enclosure front side 52 and drawer backside 67, thereby preventing the drawer 60 from being accidentally removed from the enclosure 50. The channels can be manually removed when withdrawal of the drawer 60 is desired. The drawer configured enclosure 50 has an open ended bottom so that as it is disposed over the cupboard configured enclosure 20 the corresponding sides are coplanar. The upwardly extending slats 38, 40, 42 and 44 provide the interlocking required to maintain the two enclosures 20 and 50 in a stable configuration. If more than two enclosures were to be stacked, the middle enclosures would also have removable slats.

A removable cover 68 is provided for covering a portion of the uppermost stacked enclosure not supporting an upper mattress support frame end as will be explained hereinbelow. The removable cover 68 is formed to incorporate a front side downward extending flange 70, a right end downward extending flange 72 and a backside downward extending flange 74.

An upper mattress support frame 80 consists of a top 82, a front side wall 84, a back side wall 86 and two end walls 88 and 90. The front side wall 84 lower edge extends downwardly further with respect to each of the two end walls 88 and 90. Similarly, the back side wall 86 lower edge also extends downwardly further with respect to the two end walls 88 and 90. The length of each of the two end walls 88 and 90 is equal to the length of the stackable enclosure end sides 26, 28, 56 and 58. Therefore it can be appreciated that as the upper mattress support frame 80 is disposed over the uppermost stacked enclosure the front and back side walls 84 and 86 respectively will overlap the front and back sides of the stackable enclosure thereby preventing any rotation of the upper mattress support frame 80 with respect to the uppermost stacked enclosure.

A lower mattress support frame 96 consists of a top 98, two end walls 100 and 102, a back side wall 104 and a front side wall 106. The front side 106 slidably receives two side by side drawers 108 and 110. Holes 112 are provided along the top of the front side 106 and back side 104 (not shown) so that a side rail 116 can be removably attached thereto by bolting three slats fixedly mounted to its lower outer surface. Similarly, the side rail 116 can be removably attached to the upper mattress support frame 80 by bolting through holes 122 provided along the top of the front 84 or the back side 86 (not shown). In a similar manner, a headboard 124 also can be removably attached by downwardly extending removable slats 125 to either end 100 or 102 of the lower mattress support frame 96 or either end 88 or 90 of the upper mattress support frame 80 through correspondingly located attachment holes 126 or 127.

An H-shaped support 130 for holding one end of the upper mattress support frame 80 consists of two elongated legs 132 and 134 connected by a crossbar 136. Two holes 138 are provided at the top of each of the elongated legs 132 and 134 and mate with corresponding holes 135 located near the lower edges of the upper mattress support frame 80 end walls 88 and 90 thereby allowing the mattress support frame 80 to be supported solely by two H-shaped supports 130 if desired. The elongated legs 132 and 134 are sufficiently long so that the holes 138 will coincide with the corresponding holes 135 in the mattress support frame 80 when the other end is supported by two of the stacked enclosures. In another embodiment to be described hereinbelow, a single enclosure is utilized for support of one end of the upper mattress support frame 80. The H-shaped support 130 is appropriately sized so that the elongated legs 132 and 134 extend upwardly only to the holes 135 provided in the upper mattress support frame 80.

An insertable bookcase 144 shown in FIG. 6 is formed with sides 146 and 148 having the same height as the sides of the stackable enclosures 20 and 50. A shelf 150 is provided midway up the sides 146 and 148 and a bottom shelf 152 connects the lower edges of the two sides 146 and 148. The bookcase is dimensioned so that when the stackable enclosures are spaced apart, the bookcase 144 can be slidably inserted into the space between the adjacent enclosure ends thereby providing additional storage space.

A support bookcase 156 shown in FIG. 2 can be used in lieu of the H-shaped support 130. The top 158 is positioned so that it will be flush with the top of the upper mattress support frame top surface 82. Holes (not shown) are provided in the back of the bookshelf, which mate with corresponding holes 135 in the upper mattress support frame end 88. Alternatively, the support bookcase can be sized so that the top 158 directly supports the upper mattress support frame 80 end. It can be appreciated that the bookcase 156 when thus used can support one end of the upper mattress support frame 80 and provide additional storage space without appreciably increasing floor space required for the furniture assembly.

The furniture modules described above can be assemblied in many different ways depending on personal preference and space availability. Three specific arrangements are described hereinbelow to illustrate some of the many arrangement possibilities. Referring to FIGS. 1 and 2, a cupboard configured stackable enclosure 20 having a slidable writing surface 36 supports an upper or drawer configured stackable enclosure 50. The four slats 38, 40, 42 and 44 provide alignment for the upper enclosure 50 and prevent any horizontal movement. At the top of the drawer configured enclosure 50 is an interlocking crossbar 162 removably mounted by screws or the like to the front and back side 52 and 54 upper edges. The crossbar 162 constrains the upper mattress support frame 80 when supported by the enclosure 50 so that it cannot slide inwardly towards the left end side 58. The removable cover 68 is sized so that it will slip over the portion of the enclosure 50 top not covered by the mattress support frame 80. The crossbar 162 can be positioned any place with respect to the top of the enclosure 50 thereby allowing the length of the assembly to be varied between the length of the mattress support frame 80 to a maximum of the length of the mattress support frame 80 plus the width of the stackable enclosure 50 less the width of the crossbar 162. In order to effect this variable length, the only furniture module requiring change is the removable cover 68 which must be sized to cover the exposed portion of the uppermost stackable enclosure 50. Attached to the upper mattress support frame 80 are the side wall 116 and headboard 124. The H-shaped support structure 130 is also attached at its upper ends to the upper mattress support frame 80. However, as previously explained, the support bookcase 156 could be utilized in lieu of the H-shaped support 130. The lower mattress support frame 96 can now be inserted endwise into the enclosure formed by the H-shaped support structure 130, upper mattress support frame 80 and stackable enclosures 20 and 50. If desired, the lower mattress support frame could be fitted with the removable headboard 124. Thus it can be seen that with a relatively limited amount of floor space a modular furniture assembly incorporating four drawers, a cupboard, shelf space and a writing surface is provided. Mattresses (not shown) rest on the mattress support frame to complete the functional assembly.

Figure 3:
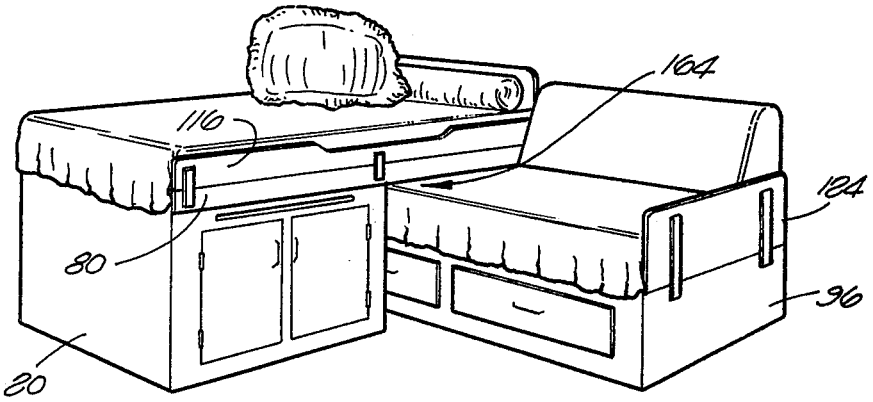
FIG. 3 is a perspective view of a second embodiment of the invention.
Figure 4:
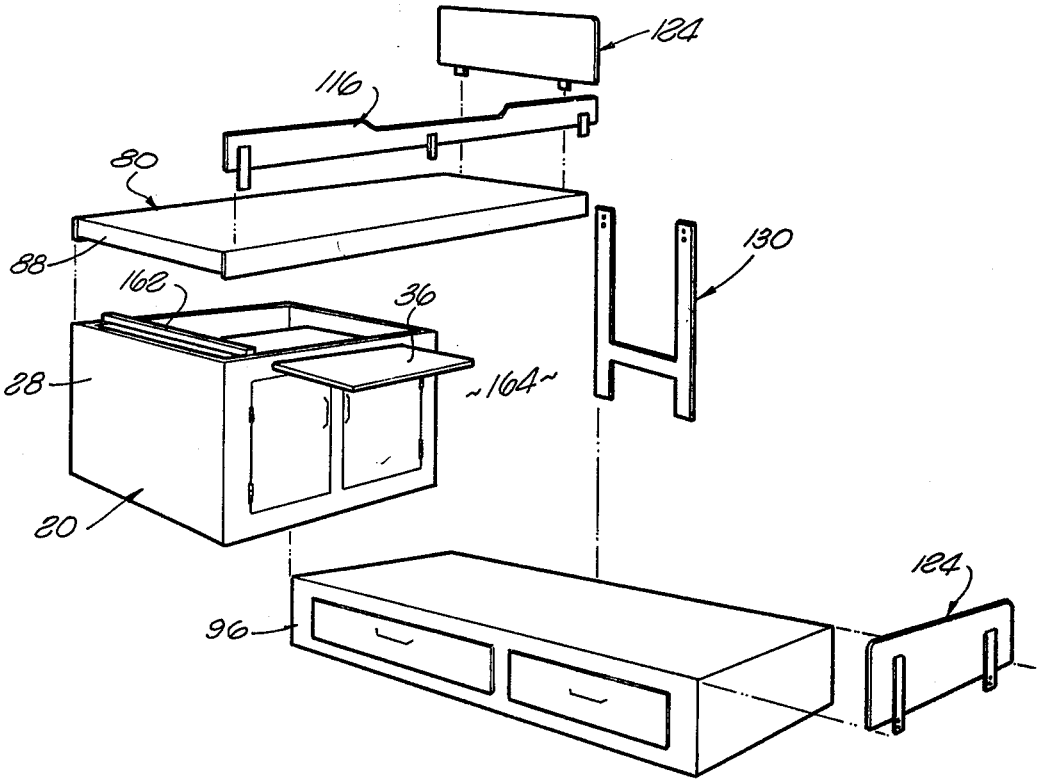
FIG. 4 is an exploded view showing the furniture modules utilized in the FIG. 3 embodiment.

A second embodiment shown in FIGS. 3 and 4 utilizes a single cupboard configured stackable enclosure 20 without the removable slats. A crossbar 162 is installed along the left end side 28 upper edge. An upper mattress support frame 80 is disposed directly above the stackable enclosure 20 with its end 88 coplanar with the enclosure left end side 28. The other end of the upper mattress support frame is supported by an H-shaped support 130 and attached in the manner previously explained. A lower mattress support frame 96 is oriented so that one end can be slidably received within the space 164 created by the cupboard configured enclosure 20, the upper mattress support frame 80 and the H-shaped support 130. With the lower mattress support frame 96 and associated mattress (not shown) slid into the thus provided space 164, a two-bed corner assembly is created utilizing the basic furniture modules described in the first embodiment. The storage space provided with this embodiment includes two drawers and a large cupboard. In addition, a pull-out writing surface 36 is also provided. The enclosure 20 could be offset in respect to the mattress support frame 80 thereby, in conjunction with a removable cover 68, providing an additional shelf.

Figure 5:
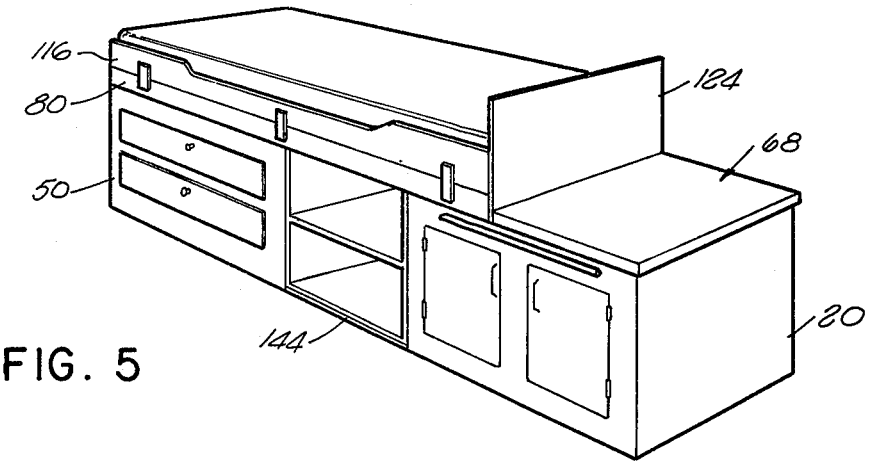
FIG. 5 is a perspective view of a third embodiment of the invention.

A third embodiment utilizing the basic furniture modules is illustrated in FIGS. 5 and 6. These modules include the removable cover 68, head board 124, side rail 116, upper mattress support frame 80, cupboard configured stackable enclosure 20, drawer configured stackable enclosure 50, slidable writing surface 36 and insertable bookcase 144. In this embodiment one mattress support frame end wall 88 completely overlaps the top of the drawer configured stackable enclosure 50 and is interlocked thereto by the downwardly extending front and back sides 84 and 86 and a crossbar 162. The other end wall 90 of the upper mattress support frame 80 partially extends over the top of the cupboard configured stackable enclosure 20 and is similarly interlocked thereto. The exposed portion of the enclosure 20 top is covered by the removable cover 68. The space created between the stackable enclosures 20 and 50 is used to contain the insertable bookcase 144. It can be appreciated that by removing the insertable bookcase 144 and repositioning the crossbar 162 on the cupboard configured stackable enclosure 20 to the right end side 26, an even more compact bed, drawer, and cupboard combination can be created. Addition of a head board 124 without the removable slats 125 and side rail 116 completes the furniture assembly.

The three embodiments described above exemplify the invention. However it will be recognized that the basic modules can be used to create furniture combinations different from those shown. Accordingly, the specific combinations disclosed are representative only and provide a basis for the claims which define the scope of the present invention.

I claim:

1. A modular furniture system comprising:

a plurality of stacked enclosures having an uppermost enclosure;

a plurality of upwardly extending members, each having a first end attached to the inner surface of a lower enclosure and a second end extending upwardly into the volume enclosed by an upper enclosure, said upwardly extending members contracting the inner surfaces of said upper enclosure thereby interlocking said upper and lower enclosures when stacked one on top of the other;

a removable cover for a first top portion of said uppermost enclosure;

an upper rectangular mattress support frame having vertically disposed side walls and end walls;

means for supporting a first end of said upper mattress support frame; and means for interlocking inner surfaces of said side walls and said end wall of a second end of said upper mattress support frame to a second top portion of said uppermost enclosure so that said upper mattress support frame is supported at said first end by said support means and at a second end by said second top portion of said uppermost enclosure and said removable cover is supported by said first top portion of said uppermost enclosure.

2. The system of claim 1 wherein said first end support means is a vertically disposed H-shaped structure which can be removably attached to said upper mattress support frame end walls.

3. The system of claim 1 wherein said first end support means is a vertically extending bookcase removably attachable to said upper mattress support frame end walls.

4. The system of claim 1 in which there are two of said stacked enclosures, the lower one of which is configured as a cupboard having a retractable writing surface and the upper one of which is configured as a chest containing two slidable drawers.

5. The system of claim 1 in which said removable cover has downwardly extending flanges on the edges which overlap said uppermost enclosure edges.

6. The system of claim 5 in which said first top portion and said second top portion comprise the entire top portion of said uppermost enclosure.

7. The system of claim 2 wherein said stacked enclosures are rectangularly shaped and said upwardly extending members are slats one of which is located adjacent each of said rectangular enclosure corners.

8. The system of claim 1 wherein said interlocking means for said upper mattress support frame second end and said second top portion of said uppermost enclosure comprises:

side walls that extend downwardly from said upper mattress support frame more than said upper mattress support frame end walls, said side walls spaced apart to overlap and extend below said uppermost enclosure front side and back side surfaces upper edges; and a crossbar removably attached to said uppermost enclosure front side and back side upper edges, said crossbar side surfaces extending upwardly therefrom and contacting the inner surface of said upper mattress support frame second end wall inner surface.

9. The system of claim 1 further comprising a lower rectangular mattress support frame having a width no greater than the space between said stacked enclosures and said supporting means for said upper mattress support frame first end.

10. The system of claim 9 wherein one of said lower mattress support frame side walls form openings for a plurality of drawers.

11. The system of claim 2 further comprising:

a longitudinally extending side board of substantially the same length as said mattress support frame side walls; and means for mounting said sideboard to either side of said upper rectangular mattress support frame.

12. The system of claim 11 wherein said side board mounting means comprises a plurality of downwardly extending slats each having one end attached to said sideboard and another end removably attachable to said upper mattress support frame.

13. The system of claim 1 further comprising a headboard; and means for mounting said headboard to either end of said upper mattress support frame.

14. The system of claim 13 wherein said headboard mounting means comprises a plurality of downwardly extending slats each having one end attached to said headboard and another end removably attachable to either end of said upper mattress support frame.

15. A modular furniture system comprising:

a stackable enclosure;

an upper mattress support frame having vertically disposed side walls and first and second end walls;

first end wall support means for supporting a first end of said upper mattress support frame; and means for interlocking inner surfaces of said side walls and said second end wall of said upper mattress support frame to the top of said stackable enclosure so that said upper mattress support frame is supported at said first end by said end wall support means and at a second end by said stackable enclosure.

wherein said interlocking means for said upper mattress support frame second end and said stackable enclosure top comprises:

side walls that extend downwardly from said upper mattress support frame more than said upper mattress support frame end walls, said side walls spaced apart to overlap and extend below said stackable enclosure front side and back side surfaces upper edges.

16. The system of claim 15 in which said first end wall support means is a vertically disposed H-shaped structure which can be removably attached to said upper mattress support frame end walls.

17. The system of claim 15 in which said first end wall support means is a vertically extending bookcase removably attached to said upper mattress support frame end wall.

18. The system of claim 15 in which said stackable enclosure top is divided into a first portion and a second portion, said second portion supporting said upper mattress support frame second end and said first portion supporting a removable cover.

19. The system of claim 15 in which said interlocking means for said upper mattress support frame second end and said stackable enclosure top further comprises:

a crossbar removably attached to said uppermost enclosure front side and back side upper edges, said crossbar side surfaces extending upwardly therefrom and contacting the inner surface of said upper mattress support frame second end wall inner surface.

20. The system of claim 15 further comprising a lower mattress support frame having a width no greater than the space between said stackable enclosure and said supporting means for said upper mattress support frame first end.

21. The system of claim 20 in which one of said lower mattress support frame side walls form openings for a plurality of drawers.

22. The system of claim 15 in which said stackable enclosure is configured as a cupboard having a retractable writing surface.

23. A modular furniture system comprising:

a first and second rectangular enclosure, each having two sides and two ends of substantially equal dimensions;

a rectangular mattress support frame having two side walls, two end walls and a top surface, the length of said side walls being substantially equal to the combined side surface length of said first and second enclosures when placed end to end and the width of said side walls being substantially equal to the end surface width of one of said enclosures; and means for interlocking said mattress support frame side wall and end wall inner surfaces to said enclosures when said mattress support frame is supported by the tops of said enclosures;

wherein said interlocking means comprises side walls that extend downwardly from said mattress support frame more than said mattress support frame end walls, said side walls spaced apart to overlap and extend below said first and second enclosure side upper edges.

24. The system of claim 23 having said enclosures placed end to end and said mattress support frame disposed over said enclosures so that each end wall is substantially coplanar with an end of each of said enclosures, wherein said interlocking means further comprising:

a first crossbar removably attached to said first enclosure side upper edges, said crossbar side surfaces extending upwardly therefrom and contacting the inner surface of one of said mattress support frame end walls; and a second crossbar removably attached to said second enclosure side upper edges, sand crossbar side surfaces extending upwardly therefrom and contacting the inner surface of the other of said mattress support frame end walls.

25. The system of claim 23 in which said first and second enclosures are spaced apart with a first end wall of said mattress support frame disposed over the entire top of said first enclosure and a second end wall disposed over a first portion of the top of said second enclosure.

26. The system of claim 25 further comprising a removable cover for a second portion of the top of said second enclosure, said first portion and second portion comprising the entire top.

27. The system of claim 26 further comprising a bookcase formed so that it can be slidably inserted into the space bounded by said spaced apart first and second enclosures and said mattress support frame.

28. The system of claim 23 in which said first rectangular enclosure is configured as a cupboard having a retractable writing surface and said second rectangular enclosure is configured as a chest containing two slidably mounted drawers.

29. A modular furniture system comprising:

a plurality of rectangular stacked enclosures having an uppermost enclosure, each of said enclosures having a front and a back side;

a plurality of upwardly extending members, each having a first end attached to the inner surface of a lower enclosure and a second end extending upwardly into the volume enclosed by an upper enclosure, said upwardly extending members contacting the inner surfaces of said upper enclosure thereby interlocking said upper and lower enclosures when stacked one on top of the other;

an upper mattress support frame having vertically disposed side walls and end walls, said side walls extending downwardly further than said side end walls and being spaced apart to overlap and extend below said uppermost enclosure front and back side upper edges;

means for supporting a first end of said upper mattress support frame; and a crossbar attached to said uppermost enclosure front side and back side upper edges, said crossbar side surfaces extending upwardly therefrom and contacting the inner surface of said upper mattress support frame second end wall inner surface.

30. A modular furniture system comprising:

a first and second rectangular enclosure, each having two sides and two ends of substantially equal dimensions;

a rectangular mattress support frame having two side walls, two end walls, and a top surface, the length of said side walls being substantially equal to the combined side surface length of said first and second enclosures when placed end to end, and the width of said end walls being substantially equal to the end surface width of one of said enclosures, said side walls extending downwardly from said mattress support frame more than said mattress support frame end walls, said side walls being spaced apart to overlap and extend below said first and second enclosure side upper edges;

a first crossbar attached to said first enclosure side upper edges, said crossbar side surfaces extending upwardly and contacting the inner surface of one of said mattress support frame end walls; and a second crossbar attached to said second enclosure side upper edges, said crossbar side surfaces extending upwardly and contacting the inner surface of the other of said mattress support frame end walls, whereby said mattress support frame is interlocked to said enclosures by said enclosure upper edges in contact with said mattress support frame side wall inner surfaces and said first and second crossbars in contact with said mattress support frame end walls.

* * * * *